United States Patent [19]

Ikeda

[11] Patent Number: 4,464,553

[45] Date of Patent: Aug. 7, 1984

[54] INDUCTION HEATING APPARATUS WITH AN OVERRIDE CIRCUIT

[75] Inventor: Tamon Ikeda, Tokyo, Japan

[73] Assignee: Sony Corporation, Tokyo, Japan

[21] Appl. No.: 281,657

[22] Filed: Jul. 9, 1981

[30] Foreign Application Priority Data

Jul. 19, 1980 [JP] Japan ..... 55-102255[U]

[51] Int. Cl.[3] ..... H05B 6/06

[52] U.S. Cl. ..... 219/10.49 R; 219/10.77; 219/489; 307/97; 307/126

[58] Field of Search ..... 219/10.49 R, 10.77, 219/10.75, 489; 340/655, 654, 652; 307/142, 126, 116, 96, 97

[56] References Cited

U.S. PATENT DOCUMENTS 4,288,705 9/1981 Barske ..... 307/142 X 4,308,443 12/1981 Tucker et al. ..... 219/10.49 R

*Primary Examiner*—Roy N. Envall, Jr.

*Assistant Examiner*—Philip H. Leung

*Attorney, Agent, or Firm*—Lewis H. Eslinger; Alvin Sinderbrand

[57] ABSTRACT

An induction heating apparatus for cooking includes an induction heating coil which generates a high frequency time-varying magnetic field used to heat a metal object; a high frequency inverting circuit which supplies a high frequency AC signal to the heating coil in response to the supply of power from a power source to control the heating coil to generate the magnetic field; a switch for connecting and interrupting the supply of power to the inverting circuit; a magnetic material detecting circuit which detects whether the object is made of a ferromagnetic material and which produces a magnetic detecting signal in response thereto; a control circuit which controls the inverting circuit in response to the magnetic detecting signal in the sense to supply the AC signal to the heating coil when the object is made of a ferromagnetic material; a switch circuit for supplying an override signal to the control circuit to cause the latter to control the inverting circuit in the sense to supply the AC signal to the heating coil regardless of whether the object is made of a ferromagnetic material; a reset circuit which resets the switch circuit in response to the connection and/or interruption of power supplied to the inverting circuit so that the switch circuit does not supply the override signal to the control circuit; and optionally, a load detecting circuit which detects the size of the object and a load reset circuit for resetting the switch circuit when the object is detected to be of a small size.

15 Claims, 3 Drawing Figures

INDUCTION HEATING APPARATUS WITH AN OVERRIDE CIRCUIT

BACKGROUND OF THE INVENTION

1. Field of the Invention

The present invention relates generally to an induction heating apparatus and, more particularly, is directed to an induction heating apparatus for cooking.

2. Description of the Prior Art

There has recently been proposed an induction heating apparatus for cooking in which an object, such as a pan or the like, which is made of a ferromagnetic material, is placed in a high frequency time-varying magnetic field. As a result, the object is heated by eddy current loss generated therein. In such heating apparatus, the object to be heated is placed on a so-called top plate made of an insulated material and is then heated as described above. In this manner, the top plate itself is not heated and there is little risk of the user being burned thereby.

It should be appreciated that such eddy current loss is greater in objects made of a ferromagnetic material. With the above induction heating apparatus for cooking, if a pan not made of a ferromagnetic material, such as aluminum or copper, and thereby constituting a light induction load, is placed on the top plate, no or little eddy current loss is generated in the pan. Thus, the pan is not heated even though an AC current is supplied to an induction heating coil for generating the time-varying magnetic field. This, of course, results in the supply current being unnecessarily consumed. It is therefore necessary to inhibit the heating operation, that is, the supply of AC current to the induction heating coil, for non-ferromagnetic objects which are not suitable for an induction heating operation.

In order to avoid the above problem, it has been proposed to provide a magnetic material detector which detects whether the object to be heated is made of a ferromagnetic material. The magnetic material detector controls the supply of current to the induction heating coil so that only objects which are made of a ferromagnetic material are heated.

However, it may be desirable to use such induction heating apparatus to heat objects made of materials which present a sufficiently heavy induction load so as to be suitable for an induction heating operation. For example, stainless steel 18-8 is less adapted for induction heating than iron, although it is more adapted for induction heating than aluminum or copper. Also, a very thin non-ferromagnetic metal container, for example, made from aluminum foil, which is sufficiently thin in comparison to the skin depth, can be heated by an induction heating operation due to the skin effect.

However, in the aforementioned known induction heating apparatus, the magnetic material detector prevents the heating of such objects made of stainless steel 18-8 and aluminum foil since such objects are not made of a ferromagnetic material. Even if the magnetic material detector can be controlled or overridden so as to cause the induction heating coil to heat such objects made of, for example, stainless steel 18-8 and aluminum foil, a problem may result during later use if an object made of a non-ferromagnetic metal material, such as stainless steel 18-8 and aluminum foil, which is not to be heated is subsequently placed on the top plate. For example, if a switch is used to override the magnetic material detector so as to heat a stainless steel 18-8 pan, and if the switch is negligently left in its operative position after the induction heating operation, there is a danger of excessively heating a second stainless steel 18-8 pan later placed on the top plate by mistake.

OBJECTS AND SUMMARY OF THE INVENTION

Accordingly, it is an object of this invention to provide a novel induction heating apparatus for cooking that avoids the above-described difficulties encountered with the prior art.

More particularly, it is an object of this invention to provide an induction heating apparatus for cooking which provides for the heating of objects made from ferromagnetic, as well as non-ferromagnetic, metal materials.

Another object of this invention is to provide an induction heating apparatus for cooking which provides a switch device which allows for the induction heating of objects made of non-ferromagnetic metal materials and which is reset after each heating operation.

Still another object of this invention is to provide an induction heating apparatus for cooking which is adapted to heat objects made of a non-ferromagnetic metal material and which is designed to prevent inadvertent induction heating of an object made of a non-ferromagnetic metal material which is not to be heated.

Yet another object of this invention is to provide an induction heating apparatus for cooking which can be controlled to heat only ferromagnetic objects or both ferromagnetic and non-ferromagnetic metal objects and which provides safe operation thereof.

In accordance with an aspect of this invention, an induction heating apparatus includes induction heating coil means for generating a time-varying magnetic field so as to heat an object; supply means for supplying an AC signal to the induction heating coil means in response to the supply of power from a power source so as to control the induction heating coil means to generate the time-varying magnetic field; means for connecting and interrupting the supply of power to the supply means; magnetic detecting means for detecting whether the object is made of a ferromagnetic material and for producing a magnetic detecting output signal in response thereto; control means for controlling the supply means in response to the magnetic detecting output signal in the sense to supply the AC signal to the induction heating coil means when the object is made of a ferromagnetic material; switch means for supplying an override signal to the control means to cause the latter to control the supply means in the sense to supply the AC signal to the induction heating coil means regardless of whether the object is made of a ferromagnetic material; and reset means for resetting the switch means in response to at least one of the connection and interruption of the supply of power to the supply means so that the switch means does not supply the override signal to the control means.

The above, and other, objects, features and advantages of the present invention will become apparent from the following detailed description of illustrative embodiments of the invention which is to be read in connection with the accompanying drawings.

DETAILED DESCRIPTION OF THE PREFERRED EMBODIMENTS

Figure 1:
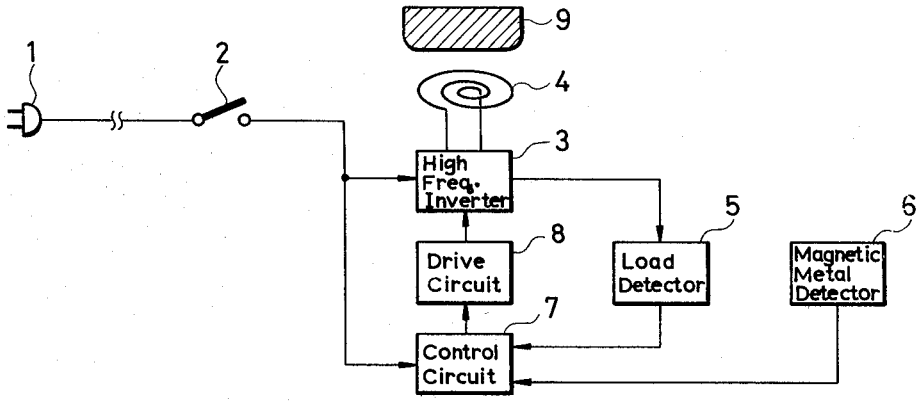
FIG.1 PRIOR ART
FIG. 1 is a block-schematic diagram of a known induction heating apparatus for cooking to which the present invention may be applied.

Referring to the drawings in detail, and initially to FIG. 1 thereof, there is shown a known induction heating apparatus for cooking with which the present invention may be applied. The induction heating apparatus of FIG. 1 operates only to heat objects made of a ferromagnetic metal material. The apparatus includes an induction heating coil 4 which generates a high frequency time-varying magnetic field for heating a ferromagnetic object 9 which is supported above heating coil 4 on an insulated top plate (not shown). Heating coil 4 is supplied with an AC signal having a high frequency in the range of, for example, 20 KHz to 100 KHz. In particular, a supply circuit or high frequency inverting circuit 3 is connected to a power source through a power source plug 1 and a power source switch 2, and generates the aforementioned AC signal supplied to induction heating coil 4 in response to the power supplied by the power source. Power source switch 2 functions to disengage (or engage) inverting circuit 3 from the power source and thereby to interrupt (or connect) the supply of power to inverting circuit 3. Accordingly, the high frequency time-varying magnetic field which is created by induction heating coil 4 results in object 9 being heated by means of eddy current loss.

In addition, the induction heating apparatus of FIG. 1 includes a magnetic material detecting circuit or magnetic metal detector 6 for detecting whether the object 9 to be heated is made of a ferromagnetic material and for producing a magnetic detecting output signal in response thereto. This latter signal is supplied to a control circuit 7 which is also connected to the power source through power source plug 1 and power source switch 2 and which, in turn, controls high frequency inverting circuit 3 through a drive circuit 8 so as to prevent or inhibit the production of the AC signal when the object 9 is detected to be of a non-ferromagnetic material. In this manner, if object 9 is made of aluminum or copper, as previously discussed, it will not be heated. Thus, for example, a non-ferromagnetic metal object made of aluminum foil which is sufficiently thin in comparison to the skin depth, and which can be heated by an induction heating operation due to the skin effect, is not heated. Accordingly, any danger inherent in the heating of such object, such as the melting thereof by excessive heat, is eliminated. It should be appreciated, however, that such danger remains in those induction heating apparatus which are not provided with a magnetic material detecting circuit. The induction heating apparatus of FIG. 1 also includes a load detecting circuit 5, for example, as discussed more fully in U.S. patent application Ser. No. 191,766, filed Sept. 29, 1980, and having a common assignee herewith. Load detecting circuit 5 detects whether the object placed on the top plate is a light or small load, that is, a small body such as a spoon, fork or the like, which is not to be heated, or whether it is a normal load such as a pan or container to be heated. When such a small body is detected, load detecting circuit 5 supplies a signal to control circuit 7 which, in turn, controls high frequency inverting circuit 3 so that the latter does not supply the AC signal to induction heating coil 4.

With the induction heating apparatus of FIG. 1, commercially available metal pans made, for example, of stainless steel 18-8, cannot be heated. In particular, since stainless steel 18-8 is not a ferromagnetic material, magnetic material detecting circuit 6 supplies an appropriate signal to control circuit 7 so that high frequency inverting circuit 3 does not supply the AC signal to induction heating coil 4. The same result occurs for containers made of thin aluminum foil. However, a stainless steel 18-8 object, although providing a lighter induction load than an iron object, still provides a heavier induction load than an aluminum or copper object, and may be the subject of an induction heating operation. In addition, thin aluminum foil containers, as aforementioned, may also be the subject of an induction heating operation. For example, it may be desirable to heat water or other liquids in an aluminum foil container. It should be appreciated that, if the heating capacity of the water or other liquid contained in an aluminum foil container is sufficiently high, the aluminum foil container is never heated to its melting temperature.

Although it may be possible to provide a selective switching device which selectively permits the heating of stainless steel 18-8 metal containers or aluminum foil containers, that is, a switching device which disengages or overrides magnetic material detecting circuit 6 from the induction heating apparatus, a problem may result. In particular, if the switching device which has been activated to provide for induction heating of, for example, the aforementioned stainless steel 18-8 metal container, is negligently left in its activated position, a non-ferromagnetic metal container, such as a thin aluminum foil container, subsequently placed on the insulated top plate by mistake may be excessively heated, possibly to its melting point. This, of course, provides a dangerous situation.

Figure 2:
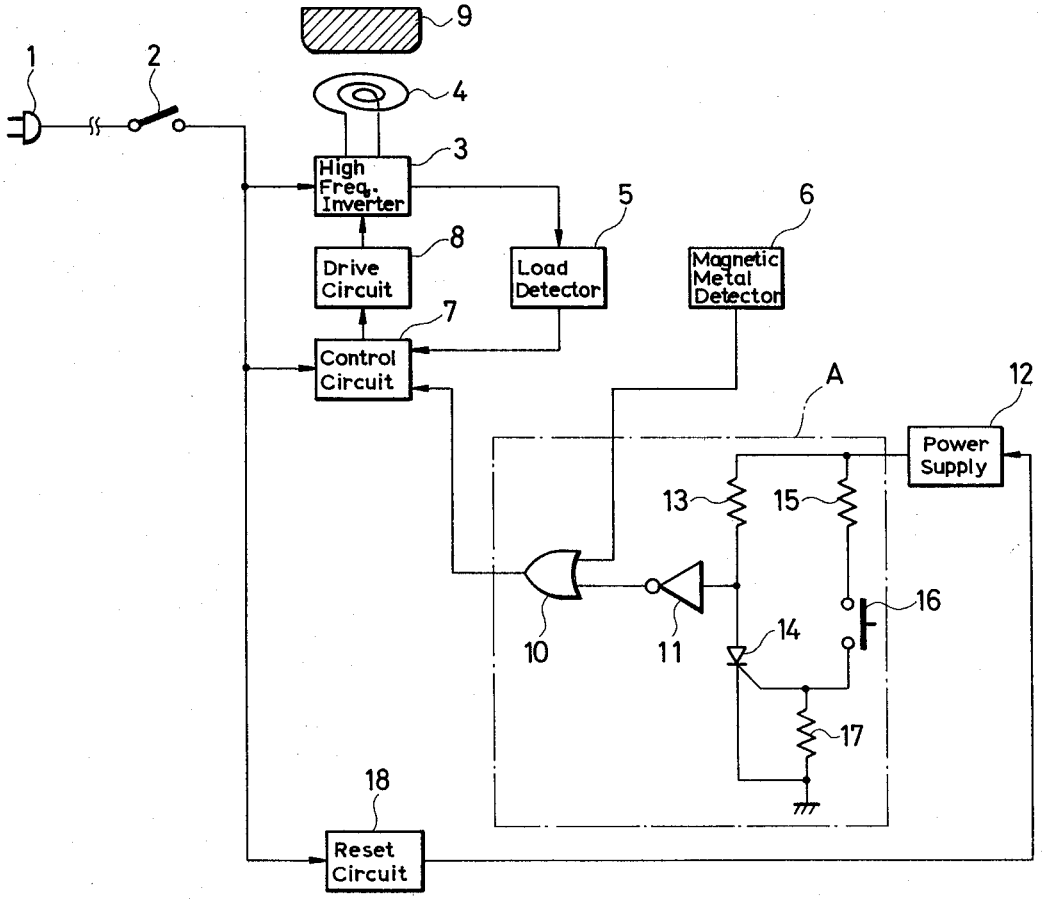
FIG. 2 is a block-circuit wiring diagram of an induction heating apparatus according to one embodiment of the present invention.

Referring now to FIG. 2, there is shown in induction heating apparatus for cooking according to one embodiment of the present invention which is designed to overcome the aforementioned problem, and in which elements corresponding to those previously described in regard to the apparatus of FIG. 1 are identified by the same reference numerals. Accordingly, the connections and operations of the elements previously described in regard to the apparatus of FIG. 1 will be omitted herein for the sake of brevity. In particular, the apparatus of FIG. 2 includes a switch circuit A which is adapted to provide for the heating of objects made of a non-ferromagnetic metal material, such as stainless steel 18-8 and aluminum foil. Switch circuit A includes a first series circuit comprised of a resistor 13 and the anode-cathode path of a thyristor 14 connected between a power supply 12 and ground. A second series circuit comprised of a resistor 15, a manually actuable device, such as a push-button switch 16 of the self-restoring type, and a resistor 17 is also connected between power supply 12 and ground. The connection point between push-button switch 16 and resistor 17 is connected to the gate input of thyristor 14. Further, the connection point between resistor 13 and the anode of thyristor 14 is connected to one input of a two-input OR gate 10 through an inverter 11, both of these latter elements also forming part of switch circuit A. The other input of OR gate 10 is supplied with the output of magnetic material detecting circuit 6 and, in response to the signals supplied thereto, OR gate 10 supplies a control signal to control circuit 7 for controlling the operation thereof. Further, a reset circuit 18 is connected at its input to the power source through power source plug 1 and power source switch 2 and functions to supply a reset signal to power supply 12.

In operation, when an object 9 to be heated is made of a ferromagnetic material, magnetic material detecting circuit 6 provides an appropriate signal to control circuit 7 through OR gate 10 whereby to control high frequency inverting circuit 3 to supply the AC signal to induction heating coil 4 to heat the object. If it is desired to heat an object made of non-ferromagnetic metal metal, such as stainless steel 18-8 or aluminum foil, manually actuable push-button switch 16 is closed, after power source switch 2 is closed. Accordingly, a switching pulse from power supply 12 is supplied to the gate input of thyristor 14 through resistor 15 and push-button switch 16 to activate the thyristor. At the same time, since power supply 12 is connected to the anode of thyristor 14 through resistor 15, thyristor 14 is turned ON whereby a low level signal results at the anode side of thyristor 14. Accordingly, a high level signal is supplied through OR gate 10 to control circuit 7. This latter circuit, in response to such signal, causes drive circuit 8 to drive high frequency inverting circuit 3 with a low output. At such time, load detecting circuit 5 detects whether the stainless steel 18-8 object 9 or the like is a normal (or heavy) load, such as a container or a pan, and supplies a respective signal to control circuit 7 in response thereto. The signal from load detecting circuit 5 causes control circuit 7, through drive circuit 8, to control high frequency inverting circuit 3 so that the latter supplies a large high frequency AC current to induction heating coil 4 for heating, for example, a stainless steel 18-8 pan or an aluminum foil container, the latter preferably containing liquid having a large heat capacity.

When the induction heating operation has been completed, power source switch 2 is opened, or alternatively, plug 1 is disengaged from its respective socket. This causes reset circuit 18 to interrupt the supply of power from power supply 12 and thereby cut off the current supply to thyristor 14 to render the latter inoperative. In this manner, switch circuit A is reset and the induction heating apparatus of FIG. 2 then operates in an identical manner to the apparatus of FIG. 1, unless push-button switch 16 is again closed to activate the gate input of the thyristor. It should be appreciated that the apparatus of FIG. 2 provides for the heating of non-ferromagnetic metal objects, independent from and regardless of the operation of magnetic material detecting circuit 6. Further, the accidental heating of a non-ferromagnetic metal object at a later time is prevented since switch circuit A is reset by the removal of power after each induction heating operation.

Figure 3:
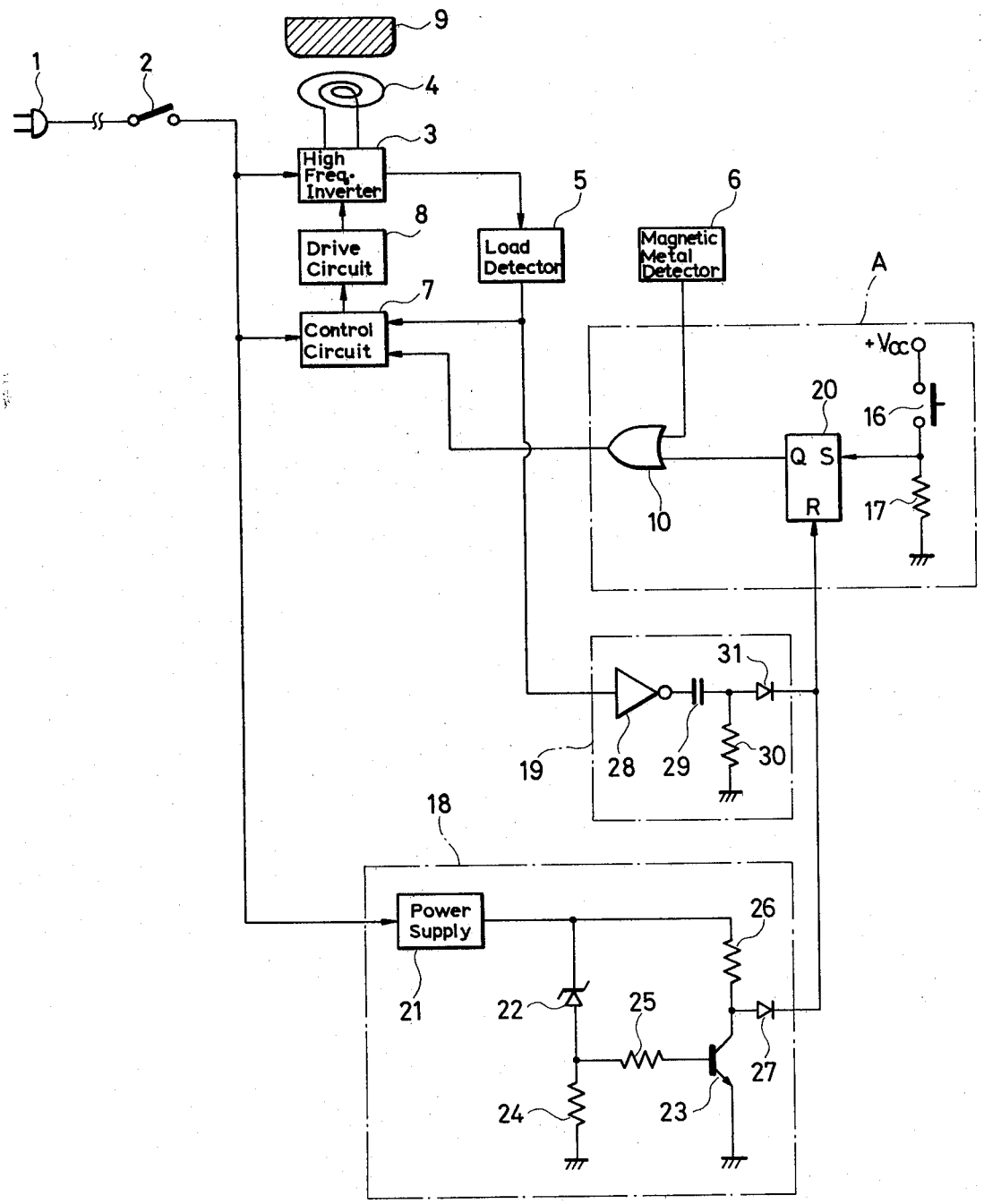
FIG. 3 is a block-circuit wiring diagram of an induction heating apparatus according to another embodiment of the present invention.

Referring now to FIG. 3, there is shown an induction heating apparatus according to a second embodiment of the present invention, in which elements corresponding to those previously described in regard to the embodiment of FIG. 2 are identified by the same reference numerals, and a discussion of the connections and operations of identical elements will not be repeated herein. As shown in FIG. 3, switch circuit A includes a push-button switch 16 connected in series with a resistor 17 between a power supply $+V_{cc}$ and ground. The connection point between push-button switch 16 and resistor 17 is connected to the set input terminal S of a set-reset flip-flop 20. The Q output of flip-flop 20 is supplied to one input of OR gate 10 and the other input thereof is supplied with the output of magnetic material detecting circuit 6. OR circuit 10 supplies an output to control circuit 7 in the same manner as previously discussed in regard to the embodiment of FIG. 2.

Reset circuit 18 includes a power supply 21 having an input connected to power source switch 2 and an output connected to ground through the series circuit of a Zener diode 22 and a resistor 24, and through the series circuit of a resistor 26 and the collector-emitter of an NPN transistor 23. A resistor 25 connects the base of transistor 23 to the connection point of Zener diode 22 and resistor 24. The collector of transistors 23 is connected through a diode 27 to the reset input terminal R of set-reset flip-flop 20.

In addition, the induction heating apparatus of FIG. 3 includes a load reset circuit 19 which, in addition to control circuit 7, is supplied with the output of load detecting circuit 5. In particular, load reset circuit 19 includes an inverter 28 supplied with the output of load detecting circuit 5. The output of inverter 28 is supplied through a capacitor 29 and a diode 31 to the reset input terminal R of flip-flop 20, and a resistor 30 is connected between ground and the connection point of capacitor 29 to diode 31. The combination of capacitor 29 and resistor 30 functions as a time constant circuit.

When power source switch 2 is closed, the output voltage from power supply 21 increases gradually from a zero or ground level to a higher level. However, since the output voltage from power supply 21 does not instantaneously reach the aforementioned higher level, there is a time dely from the time when power source switch 2 is closed until the time when Zener diode 22 is turned ON. During this time delay, transistor 23 is inoperative so that the voltage at the collector of transistor 23 is equal to the increasing output voltage from power supply 21. This increase or jump in the output voltage from a zero level to the level needed to turn ON Zener diode 22, and thereby transistor 23, is supplied through diode 27 to reset input terminal R of flip-flop 20 as the reset signal therefor. Accordingly, flip-flop 20 is reset and no override signal is supplied to control circuit 7 through OR gate 10. When Zener diode 22 turns ON, this results in transistor 23 being turned ON whereby the collector thereof is effectively grounded. This means that the reset signal is no longer supplied to flip-flop 20.

If push-button switch 16 is not actuated to its closed position, switch circuit A is inoperative and the apparatus of FIG. 3 operates in an identical manner to the apparatus of FIG. 1. If, after flip-flop 20 has been reset, push-button switch 16 is closed, flip-flop 20 is set and produces a high level signal at its Q output which is supplied to control circuit 7 through OR gate 10 in much the same manner as previously described in regard to the apparatus of FIG. 2. Thus, object 9 is heated regardless of whether it is made of a ferromagnetic material. In this manner, an aluminum foil container or a pan made of stainless steel 18-8 can be heated. At such time, since power supply 21 is operative to turn Zener diode 22 ON, and to thereby turn ON transistor 23, the collector of transistor 23 remains at ground potential so that no reset signal is supplied to reset input terminal R of flip-flop 20.

At the end of the induction heating operation of the non-ferromagnetic metal object, it may be desirable to heat another object without opening power source switch 2. In such case, there is a danger that a non-ferromagnetic metal material may inadvertently be heated at a later time. Accordingly, after the induction heating operation of the non-ferromagnetic metal object 9, this latter object is removed from the apparatus. At such time, load detecting circuit 5 detects a light or no load connection and supplies a low level signal to inverter 28 of load reset circuit 19. Inverter 28 supplies an inverted or high level signal through the time constant circuit of capacitor 29 and resistor 30 and through diode 31 to the reset input terminal R of flip-flop 20 for resetting flip-flop 20. Accordingly, even if power source switch 2 is accidentally left in its closed position, the removal of the heated non-ferromagnetic metal object 9 from the apparatus causes flip-flop 20 to be reset. This means that push-button swtich 16 must again be actuated to heat another non-ferromagnetic metal object.

It should be appreciated that many modifications may be made within the scope of this invention. For example, in the embodiment of FIG. 3, it may be desirable to provide that reset circuit resets flip-flop 20 after each disconnection or opening of power source switch 2, rather than, or in addition to, each connection or closing of power source switch 2. This may be accomplished by providing power supply 21 with a capacitor-resistor time constant circuit. In such case, when power source switch 2 is opened, the capacitor (not shown) of power supply 21 will begin discharging. When a threshold level is reached, Zener diode 22 is turned OFF which, in turn, results in transistor 23 being turned OFF. Thus, the collector of transister 23, at such time, is supplied with the output from power supply 21. In other words, the voltage at the collector of transistor 23 jumps from ground level to the discharging level of the capacitor of power supply 21, and thereafter decays to zero. This jump in voltage level results in a reset signal being supplied to reset input terminal R of flip-flop 20 through diode 27. This means that the output at the Q terminal of flip-flop 20 is at a low level so that, during subsequent operations when switch 2 is again closed, no induction heating operation of non-ferromagnetic metal objects will occur unless push-button switch 16 is again reset or closed. Further, a mode display lamp or alarm may be provided for indicating the heating of a non-ferromagnetic metal object. Also, other modifications, for example, in accordance with the aforementioned U.S. patent application Ser. No. 191,766, may be made.

Having described specific preferred embodiments of the invention with reference to the accompanying drawings, it is to be understood taht the invention is not limited to those precise embodiments, and that various changes and modifications may be effected therein by one skilled in the art without departing from the scope or spirit of the invention as defined in the appended claims.

What is claimed is:

1. Induction heating apparatus comprising:

induction heating coil means for generating a time-varying magnetic field so as to heat an object;

AC signal supply means for supplying an AC signal to said induction heating coil means in response to the supply of power from a power source so as to control said induction heating coil means to generate said time-varying magnetic field;

means for connecting and interrupting said supply of power to said AC signal supply means;

magnetic detecting means for detecting whether said object is made of a ferromagnetic material and for producing a magnetic detecting output signal in response thereto;

control means for controlling said AC signal supply means in response to said magnetic detecting output signal so that said AC signal supply means supplies said AC signal to said induction heating coil means when said object is made of a ferromagnetic material;

switch means for supplying an override signal to said control means to cause the latter to control said AC signal supply means to supply said AC signal to said induction heating coil means regardless of whether said object is made of a ferromagnetic material; and reset means for resetting said switch means in response to at least one of the connection and interruption of said supply of power to said AC signal supply means so that said switch means does not supply said override signal to said control means.

2. Induction heating apparatus according to claim 1; in which said switch means includes semiconductor means for producing said override signal and actuable means for activating said semiconductor means to supply said override signal to said control means.

3. Induction heating apparatus according to claim 1; further including load detecting means for detecting whether said object has a predetermined characteristic and for supplying a load detecting signal to said control means in response thereto to cause the latter to control said AC signal supply means to supply said AC signal to said induction heating coil means only when said object has said predetermined characteristic.

4. Induction heating apparatus according to claim 3 in which said switch means includes flip-flop means having a set input for causing said switch means to produce said override signal, and a reset input for inhibiting said switch means from producing said override signal, and said apparatus further includes load reset means for supplying a reset signal to said reset input for inhibiting the production of said override signal by said switch means when said load detecting means detects that said object does not have said predetermined characteristic.

5. Induction heating apparatus according to claim 4; in which said load reset means includes inverter means supplied with said load detecting signal and which produces an output in response thereto, time constant means supplied with the output of said inverter means, and diode means for producing said reset signal in response to the output of said time constant means.

6. Induction heating apparatus according to claim 1; in which said switch means includes flip-flop means and actuable means for activating said flip-flop means to produce said override signal.

7. Induction heating apparatus according to claim 6; in which said switch means further includes OR gate means having a first input supplied with said override signal and a second input supplied with said magnetic detecting output signal, said OR gate means supplying an output to said control means in response to the signals supplied thereto.

8. Induction heating apparatus according to claim 7; in which said actuable means is connected between a power supply and ground and produces an actuating signal upon activation thereof, and said flip-flop means includes a set-reset flip-flop having a set input adapted to be supplied with said actuating signal for causing said set-reset flip-flop to produce said override signal.

9. Induction heating apparatus according to claim 6; in which said flip-flop means has a set input adapted to be activated by said actuable means for causing said switch means to produce said override signal, and a reset input adapted to be activated by a reset signal for inhibiting the production of said override signal, and said reset means supplies said reset signal to said reset input in response to at least one of the connection and interruption of said supply of power to said AC signal supply means.

10. Induction heating apparatus according to claim 9, in which said reset means includes power supply means having an input supplied with said supply of power from said power source, diode means connected between the output of said power supply means and a reference potential, and a transistor having a collector-emitter path connected between the output of said power supply means and a reference potential and having a base connected to said diode means.

11. Induction heating apparatus according to claim 10; in which said diode means includes a Zener diode, and in which said reset means further includes a first resistive element connected between said Zener diode and said first-mentioned reference potential, a second resistive element connected between the base of said transistor and the connection point of said Zener diode and said first resistive element, and second diode means connected between the collector of said transistor and the reset input of said flip-flop means.

12. Induction heating apparatus according to claim 1; in which said AC signal is a high frequency AC signal.

13. Induction heating apparatus comprising:

induction heating coil means for generating a time-varying magnetic field so as to heat an object;

AC signal supply means for supplying an AC signal to said induction heating coil means in response to the supply of power from a power source so as to control said induction heating coil means to generate said time-varying magnetic field;

means for connecting and interrupting said supply of power to said AC signal supply means;

magnetic detecting means for detecting whether said object is made of a ferromagnetic material and for producing a magnetic detecting output signal in response thereto;

control means for controlling said AC signal supply means in response to said magnetic detecting output signal so that said AC signal supply means supplies said AC signal to said induction heating coil means when said object is made of a ferromagnetic material;

switch means for supplying an override signal to said control means to cause the latter to control said AC signal supply means to supply said AC signal to said induction heating coil means regardless of whether said object is made of a ferromagnetic material, said switch means including semiconductor means for producing said override signal, actuable means for activating said semiconductor means to supply said override signal to said control means, and OR gate means having a first input supplied with said override signal from said semiconductor means and having a second input supplied with said magnetic detecting output signal, said OR gate means supplying an output to said control means in response to the signals supplied thereto; and reset means for resetting said switch means in response to at least one of the connection and interruption of said supply of power to said AC signal supply means so that said switch means does not supply said override signal to said control means.

14. Induction heating apparatus comprising:

induction heating coil means for generating a time-varying magnetic field so as to heat an object;

AC signal supply means for supplying an AC signal to said induction heating coil means in response to the supply of power from a power source so as to control said induction heating coil means to generate said time-varying magnetic field;

means for connecting and interrupting said supply of power to said AC signal supply means;

magnetic detecting means for detecting whether said object is made of a ferromagnetic material and for producing a magnetic detecting output signal in response thereto;

control means for controlling said AC signal supply means in response to said magnetic detecting output signal so that said AC signal supply means supplies said AC signal to said induction heating coil means when said object is made of a ferromagnetic material;

power supply means;

switch means for supplying an override signal to said control means to cause the latter to control said AC signal supply means to supply said AC signal to said induction heating coil means regardless of whether said object is made of a ferromagnetic material, said switch means including semiconductor means for producing said override signal and actuable means for activating said semiconductor means to supply said override signal to said control means, said semiconductor means including a thyristor having an anode connected to said power supply means and a gate connected to said power supply means through said actuable means so that activation of said actuable means causes said thyristor to be rendered operative; and reset means for resetting said switch means in response to at least one of the connection and interruption of said supply of power to said AC signal supply means so that said switch means does not supply said override signal to said control means.

15. Induction heating apparatus according to claim 14; in which said reset means interrupts the supply of power from said power supply means to said thyristor in response to interruption of said supply of power from said power source to said AC signal supply means so as to render said switch means inoperative.

* * * * *